US006864769B2

(12) United States Patent
Germain et al.

(10) Patent No.: US 6,864,769 B2
(45) Date of Patent: Mar. 8, 2005

(54) LOCKOUT MECHANISM FOR RESIDUAL CURRENT DEVICES

(75) Inventors: Frantz Germain, Rosedale, NY (US); Stephen Stewart, Uniondale, NY (US); Armando Calixto, Floral Park, NY (US); Steve Campolo, Malverne, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 558 days.

(21) Appl. No.: 09/905,713

(22) Filed: Mar. 19, 2001

(65) Prior Publication Data

US 2003/0016101 A1 Jan. 23, 2003

Related U.S. Application Data

(60) Provisional application No. 60/227,097, filed on Mar. 19, 2001.

(51) Int. Cl.[7] ..... H01F 9/00

(52) U.S. Cl. ..... 335/172; 335/18

(58) Field of Search ..... 335/165–190, 335/18, 25–38; 361/42–50

(56) References Cited

U.S. PATENT DOCUMENTS

| | | | | | |
|---|---|---|---|---|---|
| 3,864,649 | A | * | 2/1975 | Doyle | 335/21 |
| 4,851,951 | A | * | 7/1989 | Foster, Jr. | 361/50 |
| 5,347,248 | A | * | 9/1994 | Herbert | 335/18 |
| 5,933,063 | A | * | 8/1999 | Keung et al. | 335/18 |

* cited by examiner

*Primary Examiner*—Lincoln Donovan
(74) *Attorney, Agent, or Firm*—Paul J. Sutton

(57) ABSTRACT

A Residual Current Device is provided with a reset lockout mechanism.

1 Claim, 2 Drawing Sheets

LOCKOUT MECHANISM FOR RESIDUAL CURRENT DEVICES

CROSS REFERENCE TO RELATED APPLICATIONS

This application claims the benefit of U.S. provisional application No. 60/227,097, filed on Mar. 19, 2001. This application is related to application Ser. No. 09/379,138 filed Aug. 20, 1999, which is a continuation-in-part of application Ser. No. 09/369,759 filed Aug. 6, 1999, which is a continuation-in-part of application Ser. No, 09/138,955, filed Aug. 24, 1998, now U.S. Pat. No. 6,040,967, all of which are incorporated herein in their entirety by reference, and related to application Ser. No. 09/379,138 filed Aug. 20, 1999, which is a continuation-in-part of application Ser. No. 09/369,759 filed Aug. 6, 1999, which is a continuation-in-part of application Ser. No. 09/138,955, filed Aug. 24, 1998, now U.S. Pat. No. 6,040,967, all of which are incorporated herein in their entirety by reference.

BACKGROUND

1. Field

The present application is directed to resettable residual current devices (RCDs). More particularly, the present application is directed to a RCD that can lockout the reset function if a predetermined condition exists.

2. Description of the Related Art

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. Presently available GFCI devices, such as the device described in commonly owned U.S. Pat. No. 4,595,894, use an electrically activated trip mechanism to mechanically break an electrical connection between the line side and the load side. Commonly owned application Ser. No. 09/138,955, filed Aug. 24, 1998, now U.S. Pat. No. 6,040,967, which is incorporated herein in its entirety by reference, describes a family of resettable circuit interrupting devices capable of locking out the reset portion of the device if the circuit interrupting portion in certain circumstances.

SUMMARY

The present application relates to a resettable RCD that may be locked out from reset. A user actuated reset lever moves from an off state to an on state through a test state. The test state will test the device and only allow progression to the on state if the test passes.

BRIEF DESCRIPTION OF THE DRAWINGS

Preferred embodiments of the present application are described herein with reference to the drawings in which similar elements are given similar reference characters, wherein.

DETAILED DESCRIPTION OF EMBODIMENTS

The present application contemplates various types of circuit interrupting devices that are capable of breaking at least one conductive path at both a line side and a load side of the device. In particular, a shim that will allow operation of an RCD is only allowed to move into operating position if a test passes.

Figure 1:
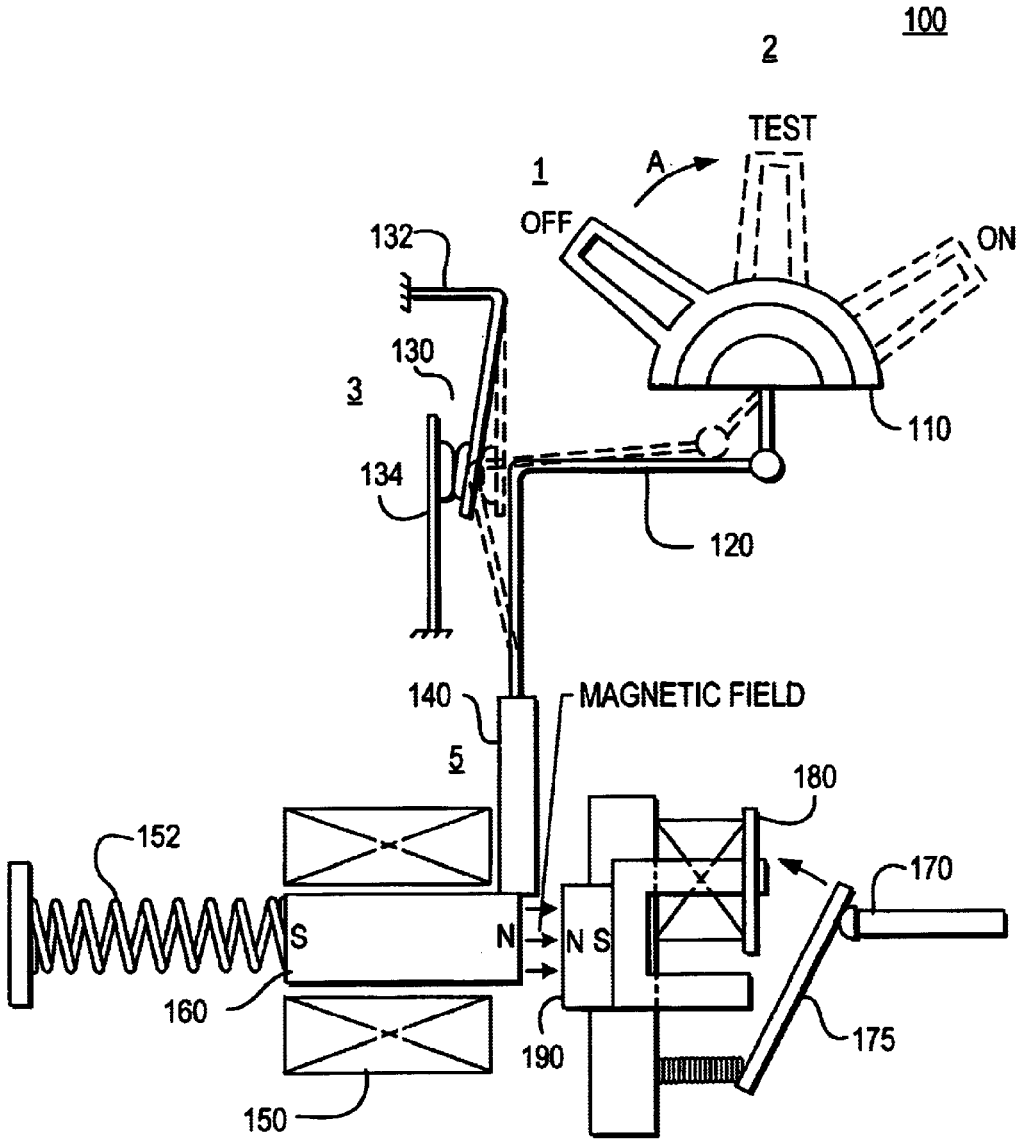
FIG. 1 is a schematic representation of the operation of an RCD in a failed condition according to the present application.

Turning now to FIG. 1, the relevant portions of the RCD are depicted, showing the motion of the mechanism as from an off state to an on state through an intermediate test state. The invention provides a non engagement (lock-out) mechanism for residual current devices (RCD Breakers).

The RCD unit 100 starts in a tripped state with the user handle 110 in the off position 1. The user operated reset handle or rocker 110 can be moved in direction A from an off state 1 to a test state 2. The handle 110 will move compression arm 120 such that switch 130 is closed by contact 132 connecting with contact 134. Then a test of the device will occur using the test circuit (not shown). If the test fails, the solenoid 150 will not move magnet 160 that is biased by spring 152 and the shim 140 will stay in place. Accordingly, the switch 175 will not close contacts 170 and 180 and the device will not pass current and will remain in the off state. When shim 140 stays in place, the magnet 160 will not allow the relay 100 to operate. Relay 195 is normally biased closed, but the magnet will hold it open.

Figure 2:
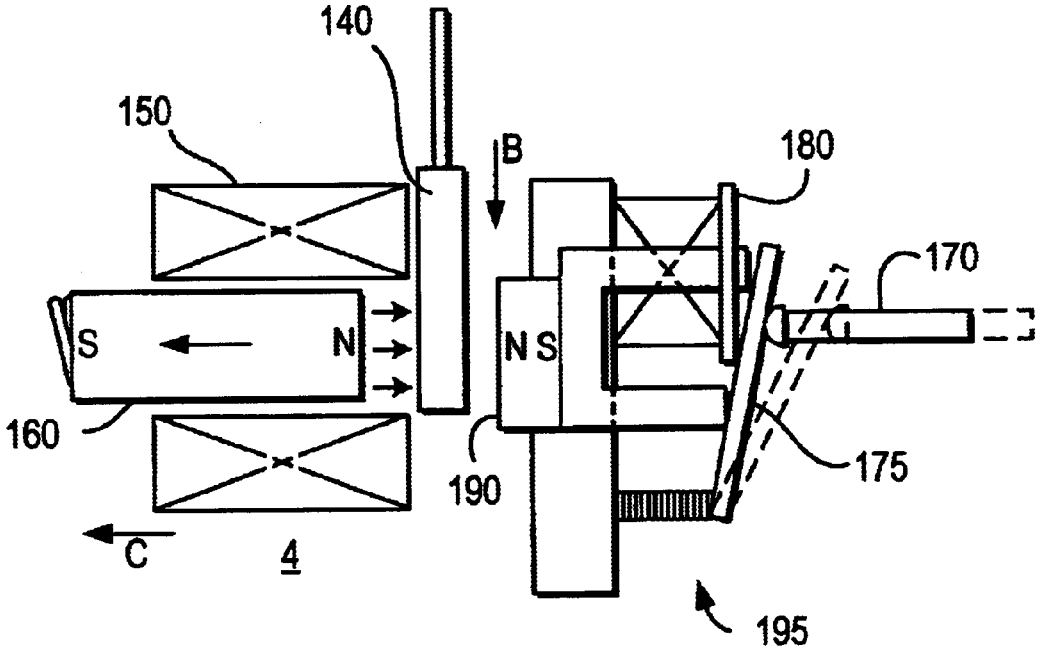
FIG. 2 is a schematic representation of the operation of an RCD in a passed condition according to the present application.

Referring now to FIG. 2, the device is shown in the state if the test passes. As can be appreciated, if the test switch 130 causes the solenoid 150 to fire, the magnet 160 will be pulled against spring 152 and the shim 140 will move down in direction B such that the shim will come down between the solenoid magnet 160 and magnet 190 so that the relay will work normally and the handle can progress to the on state. The normally closed relay 195 will then close.

As noted, although the components used during circuit interrupting and device reset operations are electromechanical in nature, the present application also contemplates using electrical components, such as solid state switches and supporting circuitry, as well as other types of components capable or making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed:

1. A residual current device having a reset lockout mechanism comprising:

a housing;

a user handle connected to a compression arm;

a solenoid having a magnetized shaft and a relay whereby the solenoid is connected to the housing; and a shim connected to the compression arm where the shim is slidably engaged to move from a position between the shaft and relay to a position where the shim is not between the shaft and the relay.

* * * * *

UNITED STATES PATENT AND TRADEMARK OFFICE

CERTIFICATE OF CORRECTION

PATENT NO. : 6,864,769 B2
APPLICATION NO. : 09/905713
DATED : March 8, 2005
INVENTOR(S) : Germain et al.

It is certified that error appears in the above-identified patent and that said Letters Patent is hereby corrected as shown below:

Title page,
Item [60], Related U.S. Application Data, Provisional Application No. "60/227,097" should read -- 60/277,097 --.

Column 1,
Line 2, Provisional Application No. "60/227,097" should read -- 60/277,097 --.
Line 8, after "reference" replace the comma "," with a period -- . --.
Lines 9 to 14, should be deleted.

Signed and Sealed this

Twenty-seventh Day of June, 2006

JON W. DUDAS
*Director of the United States Patent and Trademark Office*